United States Patent [19]

Bianchetta

[11] 4,355,565

[45] Oct. 26, 1982

[54] FLUID CIRCUIT WITH ZERO LEAK LOAD CHECK AND BY-PASS VALVE

[75] Inventor: Donald L. Bianchetta, Coal City, Ill.

[73] Assignee: Caterpillar Tractor Co., Peoria, Ill.

[21] Appl. No.: 206,192

[22] PCT Filed: Mar. 24, 1980

[86] PCT No.: PCT/US80/00321

§ 371 Date: Mar. 24, 1980

§ 102(e) Date: Mar. 24, 1980

[87] PCT Pub. No.: WO81/02768

PCT Pub. Date: Oct. 1, 1981

[51] Int. Cl.[3] ..... F15B 11/16

[52] U.S. Cl. ..... 91/518; 91/445; 91/447; 91/523; 137/599.2; 251/282

[58] Field of Search ..... 91/445, 447, 448, 521, 91/522, 523, 524, 526, 527, 529, 531, 518; 137/599.2; 251/282

[56] References Cited

U.S. PATENT DOCUMENTS

| | | | |
|---|---|---|---|
| 2,766,585 | 10/1956 | Wittren | 91/447 |
| 2,836,196 | 5/1958 | Gunn | 91/523 |
| 2,959,190 | 11/1960 | Barnes | 91/445 |
| 3,500,721 | 3/1970 | Allen | 91/412 |
| 3,811,363 | 5/1974 | Cryder | 91/531 |
| 3,906,840 | 9/1975 | Bianchetta | 91/445 |
| 3,943,825 | 3/1976 | Bianchetta | 91/445 |
| 4,000,683 | 1/1977 | Schexnayder | 91/445 |
| 4,094,228 | 6/1978 | Schexnayder | 60/484 |
| 4,102,250 | 7/1978 | Schexnayder | 91/452 |
| 4,194,532 | 3/1980 | Hall | 91/447 |
| 4,204,459 | 5/1980 | Johnson | 91/445 |
| 4,258,610 | 3/1981 | Maucher | 91/445 |

FOREIGN PATENT DOCUMENTS

| | | | |
|---|---|---|---|
| 1196927 | 7/1965 | Fed. Rep. of Germany . | |
| 2036547 | 7/1970 | Fed. Rep. of Germany . | |
| 2305798 | 8/1974 | Fed. Rep. of Germany | 91/447 |
| 2544579 | 4/1977 | Fed. Rep. of Germany . | |
| 1502234 | 2/1978 | United Kingdom . | |

*Primary Examiner*—Abraham Hershkovitz
*Attorney, Agent, or Firm*—John W. Grant

[57] ABSTRACT

A load check valve is normally employed in association with a double-acting hydraulic cylinder, such as the type used to raise and lower the boom of a construction vehicle. Conventional check valves of the poppet type are difficult to modulate whereas check valves of the spool type generally do not insure leakage control at an acceptable rate during normal operation. The spool-type load check valve (20) of this invention, used in conjunction with additional check valves (60,61), overcomes the latter problem by providing a series of interconnecting passages and chambers (36) for communicating equalized fluid pressure from a cylinder (11) to either end of the spool (27) thereof to provide for minimal leakage. When a pair of such cylinders (11,12) are utilized, the load check valves (20,20') associated therewith are interconnected by a balance line (50) and resolver valves (47') to insure equalization of fluid pressure in the cylinders upon actuation thereof and to further insure a gradual descent of a load carried by the cylinders upon loss of fluid pressure between the check valves.

3 Claims, 3 Drawing Figures

LOAD 11
12
22
65
50
20'
20
64
72
59
62
56
15
23
71
60
61
73
76
66
69
74
23
70
15
75
77
23
79
78
15
16
68
67
58
58
19
63
17
10
14
13
18
15

FLUID CIRCUIT WITH ZERO LEAK LOAD CHECK AND BY-PASS VALVE

DESCRIPTION

TECHNICAL FIELD

This invention relates generally to a fluid circuit, and more particularly relates to a fluid circuit having a load check and by-pass valve having zero leakage when associated with a fluid cylinder.

BACKGROUND ART

Construction vehicles, such as hydraulic excavators, employ work tools thereon which are normally actuated by double-acting hydraulic cylinders. For example, the cylinders may be employed to selectively actuate the boom, stick, and bucket of the excavator. The hydraulic circuit employed to selectively actuate the cylinders generally includes a load check valve to ensure that a load carried by a cylinder upon its extension and isolation, for example, will not descend abruptly upon loss of hydraulic fluid pressure in the circuit.

In certain commercial applications, the load check valve takes the form of a standard poppet valve to block the escape of fluid from the cylinder when it is maintained in an actuated condition of operation. However, such poppet valves are difficult to control in respect to closely modulating fluid flow in the circuit.

In conventional applications wherein the load check valve includes a reciprocal spool, it is well known that spools of this type do not insure leakage control at an acceptable rate during normal operation. A load check valve of this type is disclosed in U.S. Pat. No. 4,102,250 issued on July 25, 1978 to Lawrence F. Schexnayder and assigned to the assignee of this application.

The present invention is directed to overcoming one or more of the problems set forth above.

DISCLOSURE OF INVENTION

In one aspect of the present invention, a fluid circuit comprises a fluid source, an actuator, control means for selectively communicating pressurized fluid to the actuator, and check valve means, including a load check valve, having a reciprocal spool, for isolating fluid pressure in the actuator in response to selective actuation of the control means. The improved load check valve of this invention includes means for communicating equalized fluid pressure from the actuator to either end of the spool when the control means is actuated to isolate fluid pressure in the actuator.

In another aspect of this invention, a pair of actuators in the form of double-acting cylinders are each connected to a load check valve, and a control means interconnects the load check valves. The improved control means includes resolver valve means for moving to a first position to equalize the fluid pressures in the cylinders upon retraction thereof and when the level of fluid pressure in one of the cylinders exceeds the level of fluid pressure in the other one, and for moving to a second position to permit gradual reduction of the level of fluid pressure in the cylinders upon loss of fluid pressure between the load check valves.

The check valve means of this invention will prevent an abrupt dropping of a load supported by the actuator and the load check valve thereof will function to control leakage therethrough at an acceptable rate during normal operation. For example, when the actuator constitutes a double-acting hydraulic cylinder employed on a construction vehicle or the like and when the cylinder is extended and under load, the check valve means will function to continuously maintain the cylinder in its extended condition of operation without causing any appreciable decay in the pressurized fluid utilized to maintain the cylinder in such extended condition. Furthermore, the load check valve is adapted for attachment to the housing of the cylinder proper, thus avoiding the need for flexible lines interconnecting the same. The feature of providing a control means interconnected between the individual load check valves of a pair of cylinders ensures that the fluid pressures in the cylinders are equalized and that any sudden loss of fluid pressure therebetween will permit the cylinders to lower a load carried thereby, gradually.

BRIEF DESCRIPTION OF THE DRAWINGS

Other objects and advantages of this invention will become apparent from the following description and accompanying drawings wherein.

BEST MODE OF CARRYING OUT THE INVENTION

Figure 1:
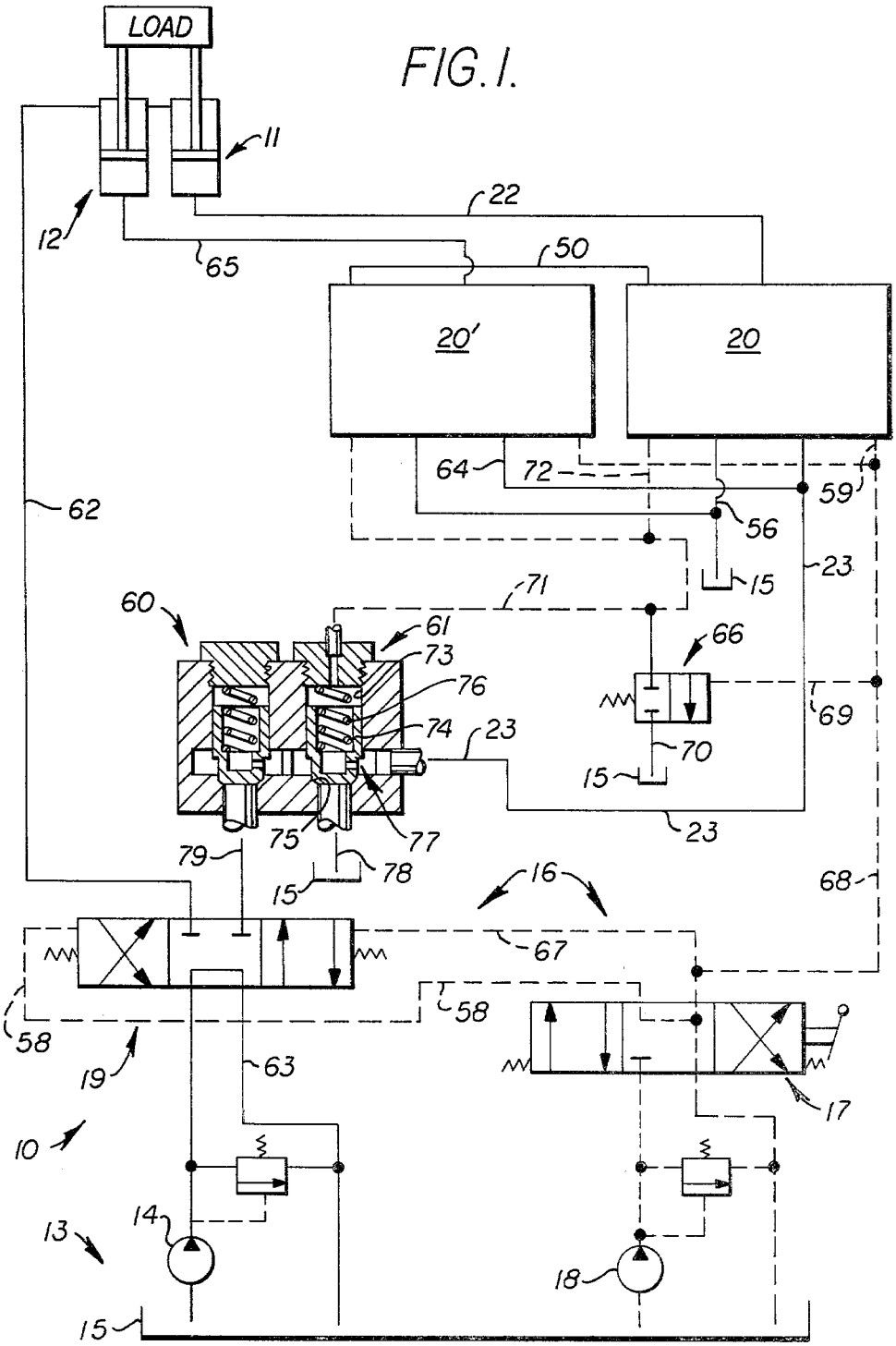
FIG. 1 schematically illustrates a fluid circuit having the improved check valve means embodiment of the present invention incorporated therein.

FIG. 1 illustrates a fluid (hydraulic) circuit 10 adapted to selectively extend or retract a pair of fluid actuators 11 and 12, shown in the form of double-acting hydraulic cylinders. A load is schematically shown, attached to the rod ends of the cylinders and may comprise a boom or bucket of an hydraulic excavator, for example. However, it should be understood that fluid circuit 10 is adapted for the control of other types of actuators employed on construction vehicles or the like which are operated by pressurized fluid.

Fluid circuit 10 further includes a pressurized main fluid source 13 having an engine-driven pump 14 and a reservoir or tank 15. A control means 16, including a manual pilot valve 17 connected to a low pressure or pilot pump 18 and a main control valve 19, are adapted to selectively communicate pressurized fluid from source 13 and pump 14 to cylinders 11 and 12. In general, shifting of three-position, four-way control valve 17 either rightwardly or leftwardly from its illustrated neutral position will function to communicate a pilot signal to valve 19 to shift the latter valve to communicate pump 14 with cylinders 11 and 12 for extension or retraction thereof. The non-pressurized ends of the cylinders will, of course, be connected with tank 15 for exhausting them of fluid pressure.

A pair of load check valves 20 and 20' will become operative to control fluid flow upon pressurization and exhaustion of the head ends of the cylinders. Since check valves 20 and 20' are substantially identical in construction and arrangement, only check valve 20 will be described in detail with reference to FIG. 2.

As discussed above, conventional check valves of the spool type are widely utilized to isolate fluid pressure in the head end of cylinders of this type when the cylinders are extended to raise the load, for example. Alternatively, although check valves of the poppet type are highly efficient for preventing leakage therethrough in the head ends of cylinders to prevent falling of the load, such poppet valves have not been widely accepted since they do not provide close control over modulation of fluid flow. Therefore, spool-type valves, such as that shown in above-referenced U.S. Pat. No. 4,102,250 are normally employed as load check valves in this type of application, but exhibit the disadvantage of being unable to maintain leakage therethrough at an acceptable rate, particularly when the spools thereof have relatively large diameters. Also, it has proven difficult to mount these type of standard check valves directly on the housings of the associated hydraulic cylinder to avoid the need for flexible conduits interconnecting the valves and cylinders.

Figure 2:
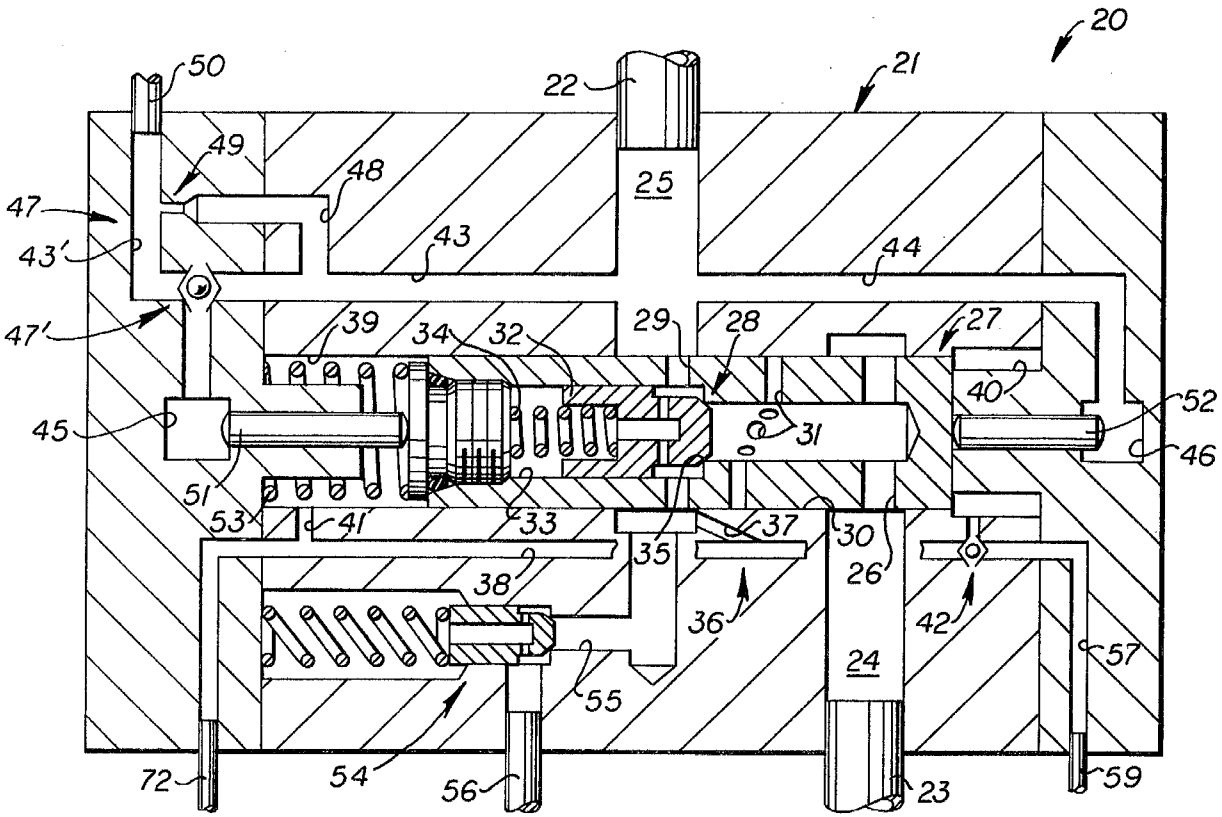
FIG. 2 is a sectional view through the check valve.

Referring to FIG. 2, load check valve 20 comprises a housing 21 which may be secured directly to the casing of cylinder 11 to thus avoid the need for an interconnecting flexible conduit, such as schematically shown at 22 in FIG. 1. Extension of cylinder 11 to raise the load is effected by pressurized fluid communicated from pump 14, in the general manner described above, to a conduit 23 connected to an inlet 24 of valve 20. The pressurized fluid is then communicated to an outlet passage 25, connected to conduit or passage 22 via a plurality of radial ports 26 defined in a reciprocal spool 27, a poppet valve 28 which is opened by the fluid pressure, and radial ports 29, also defined in spool 27. Spool 27 is slidably mounted in an elongated bore 30, defined in housing 21, and has a plurality of additional ports 31 defined therein communicating with ports 26 for purposes hereinafter explained. Poppet valve 28 is standard and comprises a valve member 32 reciprocally mounted in a bore 33, defined in spool 27, and a compression coil spring 34 for biasing the valve member towards a closed position on a seat 35, defined on the spool.

A unique feature of check valve 20 is the provision of means 36 for communicating equalized fluid pressure from cylinder 11 to either end of spool 27 when control means 16 is not actuated, isolating fluid pressure in the head end of cylinder 11. Thus, such means will function in conjunction with hereinafter described check valves 60 and 61 to minimize any leakage from the circuit. For purposes herein, check valves 20, 60, and 61 may be considered to comprise "check valve means" for isolating fluid pressure in cylinder 11 upon selective actuation of control means 16. Means 36 includes an orifice 37 which communicates passage 25 with an elongated passage 38 to, in turn, communicate equalized fluid pressure from the head end of cylinder 11 to chambers 39 and 40, defined at opposite ends of spool 27. Passage 38 communicates with chamber 39 through a passage 41, whereas passage 38 communicates with chamber 40 through a resolver valve 42.

As explained more extensively hereinafter, upon extension of cylinder 11 to raise the load, and assuming that the load is held at its raised position by moving pilot control valve 17 to its neutral or intermediate position illustrated in FIG. 1, fluid pressures in each of the chambers 39 and 40 will be equalized. As further described more fully hereinafter, the lines shown in FIG. 2 downstream of load check valve 20 are also isolated to maintain a minimal leakage condition of check valve 20, under further control of check valves 60 and 61.

Means 36 may be considered to further include a pair of branch passages 43 and 44 which are interconnected between outlet passage 25 and chambers 45 and 46, respectively. Pressurized fluid is communicated to chamber 45 from passage 25 via a ball resolver 47' of a control or resolving means 47. As described more fully hereinafter, resolving means 47 further includes a passage 48 interconnecting passages 43 and 43' and having a restricted orifice 49 therein for intercommunicating check valves 20 and 20' via a balance line 50.

Pressurized fluid in chambers 45 and 46 will act on the ends of pistons 51 and 52, respectively, with a compression coil spring 53 also acting on the left end of spool 27 in FIG. 2 to supplement the force of piston 51. Excessive pressures in passage 25 will be relieved by a standard relief valve 54, via a connecting passage 55 and a drain line 56.

When the operator desires to lower the load by retracting cylinders 11 and 12, a pilot line 57 will communicate a pressurized pilot signal to chamber 40 in FIG. 2, past resolver valve 42, to move spool 27 leftwardly against the opposed biasing force of spring 53. As more fully explained hereinafter, metering holes 31 will intercommunicate passages 25 and 24 to modulate venting of pressurized fluid in the head end of cylinder 11 to tank 15.

Figure 3:
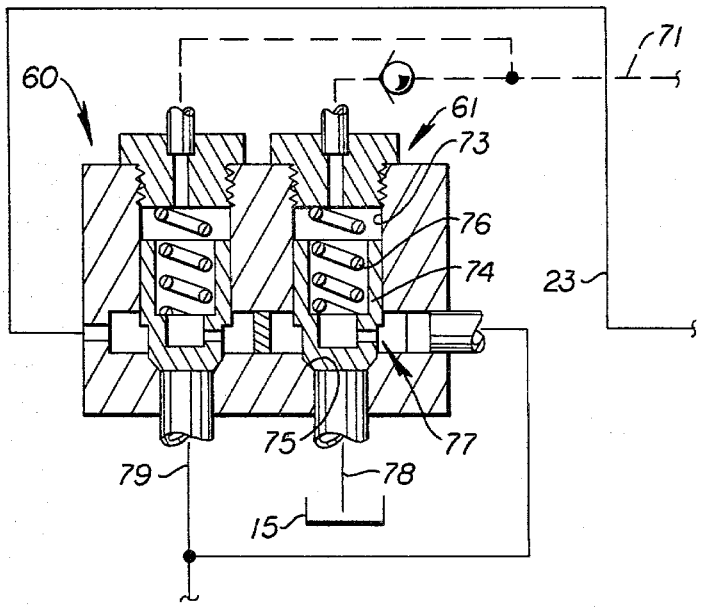
FIG. 3 is an alternate arrangement of the check valves shown in FIG. 1.

Referring to FIG. 3, an alternate embodiment of check valves 60 and 61 is shown. In this embodiment, conduit 23 communicates with valve 19 through check valve 60. Flow from line 79 is in communication with tank 15 through check valve 61. Check valves 60 and 61 open to communicate fluid flow between lines 23 and 79, 78 and 79 in response to vent 71 being vented to tank 15 through vent valve 66.

INDUSTRIAL APPLICABILITY

Fluid control circuit 10 of FIG. 1 finds particular application to construction vehicles of the type wherein a double-acting hydraulic cylinder is utilized to raise and lower an implement, such as the boom employed on an hydraulic excavator. Although check valve 20 is particularly useful with the specific type of control circuit illustrated in FIG. 1, it should be understood that modifications and variations well known to those skilled in the art may be made to the control circuit without distracting from the inventive concepts disclosed and claimed herein.

FIG. 1 illustrates control circuit 10 in a neutral condition of operation whereby pilot control valve 17 and main control valve 19 are maintained in their intermediate positions, isolating pump 14 from cylinders 11 and 12. Raising of the load is effected by shifting pilot control valve 17 rightwardly in FIG. 1 to communicate pilot fluid pressure from pump 18 to main control valve 19, via a line 58. In response thereto, main control valve 19 will be shifted rightwardly to communicate fluid pressure from pump 14 to a line 79 which will open check valve 60 to, in turn, communicate such fluid pressure past a vented make-up or check valve 61 and to line 23. Simultaneously therewith, a return line 62 which is common to the rod ends of cylinders 11 and 12 will communicate with tank 15 via a line 63.

As shown in FIG. 2, main pump pressure communicated to line 23 will communicate to the passage 25 and, thus, the head end of cylinder 11 via passage 24, ports 26, open poppet valve 28, ports 29, and passage 25. A branch line 64 (FIG. 1) is interconnected between line 23 and load check valve 20' to pressurize the head end of cylinder 12 in a like manner, via a line 65.

Should the operator desire to maintain cylinders 11 and 12 in their extended positions, he need only shift pilot control valve 17 back to its intermediate or neutral position illustrated in FIG. 1 to isolate the head ends of the cylinders. Since cylinder pressure is communicated to either end of valve spool 27 via passage 25, orifice 37, and passage 38 which communicates with chambers 39 and 40, check valve 20 will be maintained in a "low leak" condition of operation. In particular, once the fluid pressure in passage 25 and in chambers 39 and 40 is equalized, no differential pressure will occur therebetween whereby the fluid will remain substantially static. It should be futher noted that a pilot-operated vent valve 66 and valves 60 and 61 remain closed to prevent any fluid leakage out of lines 23 and 71.

Should the operator then desire to lower the load by retracting cylinders 11 and 12, he will shift pilot control valve 17 leftwardly in FIG. 1 to connect pilot pressure from pump 18 to main control valve 19 via a line 67. Main control valve 19 will be shifted leftwardly to communicate working pressure from pump 14 to line 62, and to connect drain line 63 with valve 60. Pilot line 67 connects with a branch pilot line 68 which, in turn, communicates pilot pressure to line 59 and to a line 69 connected to vent valve 66, having a vent line 70.

Pilot pressure in line 69 will shift vent valve 66 leftwardly in FIG. 1 to vent line 71, connected to passage 38 (FIG. 2) by a branch line 72. Thus, a working chamber 73 of check valve 61 will be exhausted of fluid pressure with a poppet 74 of the check valve being solely held against a seat 75 by a relatively light spring 76. Simultaneously therewith, line 72 will vent chamber 39, via passages 41 and 38, whereas resolver valve 42 will be shifted leftwardly in FIG. 2 to close passage 38 thereat due to pilot pressure communicated thereto via pilot line 59 and passage 57.

Pilot pressure is thus communicated to chamber 40 to shift spool 27 leftwardly against the opposed modulating biasing force of spring 53 to place line 22 in communication with line 23 to gradually vent the head end of cylinder 11. In particular, metering ports 31 will gradually communicate with passage 25 whereby pressurized fluid from the head end of cylinder 11 is permitted to communicate with passage 24 and, thus, line 23 via ports 26. The various passages and ports just described may be suitably calibrated and arranged to provide the desired fluid flow patterns whereby a load may be permitted to descend at a predetermined rate.

The fluid in line 23 which is now being exhausted, but is still under pressure due to the retraction of cylinder 11, will open poppet 74 of check valve 61 against the relatively light force of spring 76 due to a differential area 77 defined on poppet 74. Thus, line 23 will communicate with a drain line 78. It should be understood that check valve 61 further functions as a make-up valve upon pressurization of the head end of cylinder 11 to add fluid to the cylinder should the speed of pump 14 fall below a predetermined amount whereby no cavitation in the cylinder will occur. If so desired, a suitable differential area may also be formed on check valve 60 to permit this valve to open to further connect line 23 with another drain line 79 upon retraction of cylinder 11.

As stated above, check valve 20' will function simultaneously with valve 20 and in a like manner, due to the common connections illustrated in FIG. 1. It is desirable to provide a separate check valve for each cylinder 11 and 12 in applications wherein the valve is secured directly on the housing of a respective cylinder. It should be noted that another feature of the fluid circuit illustrated in FIG. 1 is that, upon retraction of cylinders 11 and 12, check valves 20 and 20' will vent fluid pressure from the head ends of the cylinders directly to tank, via line 78 (assuming that check valve 60 is constructed without a differential area 77 so that it remains closed during the venting phase of operation) whereby main control valve 19 is bypassed.

Another feature of fluid circuit 10 is the interaction between check valves 20 and 20' by the resolver means 47 employed therein. Upon extension of cylinders 11 and 12, balance line 50 will ensure that the fluid pressure in the head ends of the cylinders is equalized. Referring to FIG. 2, line 50 will communicate with the head end of cylinder 11, for example, via orifice 49; passages 48, 43, and 25; and line 22. The ball of resolver valve 47' will have moved leftwardly to block passage 43 thereat, but to permit communication of the latter passage with chamber 45.

Upon retraction of cylinders 11 and 12, should the fluid pressure in the head end of cylinder 12 exceed the fluid pressure in the head end of cylinder 11, resolver valve 47' will shift rightwardly in FIG. 2 to feed a pressure signal to chamber 45 via line 50. Fluid pressure in chamber 45 will move piston 51 and spool 27 rightwardly to at least partially close off metering holes 31 until the fluid pressure in the head ends of the cylinders is equalized. Also, some fluid pressure will be communicated to the head end of cylinder 11 via orifice 49 and passages 48 and 43.

Should a break occur in line 50, the ball of resolver valve 47' will move leftwardly in FIG. 2, to block passage 43 thereat. Pressurized fluid in the head end of cylinder 11 will dissipate gradually, since it is forced to escape through broken line 50 via passage 48 and orifice 49. Orifice 49 can be suitably sized to closely control the rate of descent of the load. The fluid pressure in cylinder 12 will also dissipate slowly should a break occur in line 50.

Other aspects, objects, and advantages of this invention can be obtained from a study of the drawings, the disclosure, and the appended claims.

I claim:

1. In a fluid circuit (10) having a pair of extensible and retractable fluid cylinders (11,12), load check valve means (20,20') for communicating fluid pressure to each of said cylinders to extend or retract the same, and control means (47) for interconnecting said load check valve means to permit gradual retraction of said cylinders upon loss of fluid pressure between said load check valve means, the improvement comprising, said control means including resolver valve means (47') for movement between first and second positions and (1) for moving to said first position to equalize the fluid pressures in said cylinders upon retraction of said cylinders and when the level of fluid pressure in one of said cylinders exceeds the level of fluid pressure in the other one of said cylinders, and (2) for moving to said second position gradually reducing the level of fluid pressure in said cylinders upon loss of fluid pressure between said load check valve means.

2. In a fluid circuit (10) having a fluid source (13), a fluid actuator (11), control means (16) for selectively communicating pressurized fluid to said actuator from said source, and check valve means (20,60,61) for isolating fluid pressure in said actuator to maintain it in an actuated position in response to selective actuation of said control means to a neutral position blocking communication of fluid from said source to said actuator, said check valve means including a load check valve

(20) having a reciprocal spool (27), the improvement comprising said load check valve further including means (36) for openly communicating equalized fluid pressure from said actuator to opposite ends of said spool when said control means is in its neutral position wherein said actuator includes a double-acting fluid cylinder (11) movable between extended and retracted conditions of operation and wherein said control means includes main control valve means (19) for movement between a first position for communicating pressurized fluid from said source to said cylinder to extend the same, a second position isolating said source from said cylinder, and a third position for communicating pressurized fluid from said source to said cylinder to retract the same, pilot control valve means (17) for communicating a pilot signal to said main control valve means to move it to its first, second, and third positions, vent valve means (66) for receiving a pilot signal from said pilot control valve means when said pilot control valve means actuates said main control valve means to its third position retracting said cylinder to open and exhaust pressurized fluid from said load check valve (20), and check valve means (61) for venting pressurized fluid from said cylinder in response to opening of said vent valve means.

3. In a fluid circuit (10) having a fluid source (13), a fluid actuator (11), control means (16) for selectively communicating pressurized fluid to said actuator from said source, and check valve means (20,60,61) for isolating fluid pressure in said actuator to maintain it in an actuated position in response to selective actuation of said control means to a neutral position blocking communication of fluid from said source to said actuator, said check valve means including a load check valve (20) having a reciprocal spool (27), the improvement comprising said load check valve further including means (36) for openly communicating equalized fluid pressure from said actuator to opposite ends of said spool when said control means is in its neutral position wherein a pair of fluid actuators (11,12) is each connected to a said load check valve (20,20'), each of said actuators including an extensible and retractable fluid cylinder, and control means (47) for interconnecting said load check valves to equalize the fluid pressure in said cylinders upon simultaneous extension or retraction thereof and to permit gradual retraction of said cylinders upon loss of fluid pressure between said load check valves wherein said control means includes resolver valve means (47') for movement between first and second positions (1) for moving to said first position to equalize the fluid pressure in said cylinders upon retraction of said cylinders and when the level of fluid pressure in one of said cylinders exceeds the level of fluid pressure in the other one of said cylinders, and (2) for moving to said second position gradually reducing the level of fluid pressure in said cylinders upon said loss of fluid pressure between said load check valves.

* * * * *